US009010913B1

(12) United States Patent
Arai

(10) Patent No.: US 9,010,913 B1
(45) Date of Patent: Apr. 21, 2015

(54) INK CARTRIDGE

(71) Applicant: Riso Kagaku Corporation, Tokyo (JP)

(72) Inventor: Masakatsu Arai, Ibaraki (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 14/109,345

(22) Filed: Dec. 17, 2013

(30) Foreign Application Priority Data

Dec. 13, 2013 (JP) ..... 2013-257944

(51) Int. Cl.
*B41J 2/175* (2006.01)

(52) U.S. Cl.
CPC ..... *B41J 2/17523* (2013.01)

(58) Field of Classification Search
USPC ..... 347/7, 66, 84, 85, 86
See application file for complete search history.

(56) References Cited

U.S. PATENT DOCUMENTS 4,764,044 A * 8/1988 Konose ..... 401/150
5,583,549 A * 12/1996 Ujita et al. ..... 347/86
6,299,296 B2 * 10/2001 Gasvoda ..... 347/85

FOREIGN PATENT DOCUMENTS

JP 09-020015 1/1997
JP 2009-023233 2/2009

OTHER PUBLICATIONS

Official Action issued Jan. 12, 2004 in JP No. 2013-257911, 2 pages total.
Official Action issued Jan. 12, 2014 in JP No. 2013-257911, 2 pages total.

* cited by examiner

*Primary Examiner* — Anh T. N. Vo
(74) *Attorney, Agent, or Firm* — Hamre, Schumann, Mueller & Larson, P.C.

(57) ABSTRACT

An ink cartridge includes a socket portion provided at one end of an ink storage container and configured to be fitted to and detached from a joint portion of a printing machine, an ink supply port provided in the socket portion, and an inner plug configured to seal an ink passage to the ink supply port in response to biasing force applied from a side of the ink storage container. An insertion shaft, provided in the joint portion, pressing the inner plug against the biasing force upon a fitting of the socket portion to the joint portion enables the ink passage to communicate with the ink supply port. An ink holding portion of the inner plug with the insertion shaft pulled out from the ink holding portion after inserted holds the ink near the ink supply port.

3 Claims, 7 Drawing Sheets

INK CARTRIDGE

CROSS REFERENCE TO RELATED APPLICATION

This application is based upon and claims the benefit of priority from the prior Japanese Patent Application No. 2013-257944, filed on Dec. 13, 2013, the entire contents of which are incorporated herein by reference.

BACKGROUND

1. Technical Field

The present invention relates to an ink cartridge.

2. Related Art

Generally, an inkjet printing machine employing an inkjet method uses multiple ink cartridges respectively storing inks of colors such as yellow (Y), magenta (M), cyan (C), and black (K).

The inkjet printing machine can perform color printing of images and characters on a paper sheet by supplying the inks from the ink cartridges of the respective colors to inkjet heads provided for the respective ink colors and by ejecting the inks to the paper sheet from the inkjet heads of the respective colors. The inkjet printing machine is thus widely used as a printing machine for home and business use. Moreover, the inkjet printing machine is configured to perform monochrome printing by using only the ink of one color of black (K).

In this case, each of the multiple ink cartridges storing the inks of the respective colors is detachably mounted on the inkjet printing machine. However, when the ink cartridge is detached from the inkjet printing machine, the ink may drip from an ink supply port of the ink cartridge because the ink still remains in the ink supply port.

In view of this, Japanese Patent Application Publication No. Hei 9-20015 proposes an ink cartridge which can prevent the ink from dripping from the ink supply port of the ink cartridge when the ink cartridge is detached from the inkjet printing machine.

Although illustration herein is omitted, the ink cartridge disclosed in Japanese Patent Application Publication No. Hei 9-20015 includes a cartridge main body. The ink supply port is formed in the cartridge main body. Moreover, an absorbent made of urethane foam or the like and configured to absorb and hold the ink leaking from the ink supply port is provided in a recess portion formed around an outer side of the ink supply port of the cartridge main body.

Meanwhile, a head holder of an inkjet recording machine (inkjet printing machine) includes an ink introducing member provided in a protruding manner. The ink supply port of the ink cartridge is fitted to and detached from the ink introducing member.

With this configuration, the ink cartridge is mounted on the inkjet recording machine. Thereafter, when the ink supply port formed in the cartridge main body is detached from the ink introduction member provided in the head holder in the protruding manner, the ink leaking from the ink supply port is held in the absorbent. Hence, it is possible to prevent the ink from dripping during replacement of the ink cartridge and from attaching to the head holder and a surface of the cartridge main body other than the portion provided with the absorbent.

SUMMARY

However, the ink cartridge described in Japanese Patent Application Publication No. Hei 9-20015 has the following problem. As described above, the absorbent configured to absorb and hold the ink leaking from the ink supply port of the cartridge main body is provided near the ink supply port. However, since the urethane foam or the like is used for the absorbent, the absorbent swells and deteriorates due to an oil-based ink and becomes unable to absorb the ink due to this deterioration.

Moreover, when the ink cartridge is repeatedly attached to and detached from the inkjet recording machine, there is a case where the amount of ink absorbed by the absorbent exceeds an absorbable amount of ink and the absorbent cannot absorb the ink anymore, thereby causing dripping of the ink from the ink supply port.

An object of the present invention is to provide an ink cartridge which can suppress dripping of an ink from an ink supply port of the ink cartridge without using an absorbent, when the ink cartridge is detached from a printing machine.

An ink cartridge in accordance with some embodiments includes an ink storage container configured to store ink, a socket portion provided at one end of the ink storage container and configured to be fitted to and detached from a joint portion of a printing machine, an ink supply port provided in the socket portion, and an inner plug configured to seal an ink passage to the ink supply port in response to biasing force applied from a side of the ink storage container. The inner plug includes an ink holding portion for an insertion shaft provided in the joint portion to be inserted, the insertion shaft pressing the inner plug against the biasing force upon a fitting of the socket portion to the joint portion enables the ink passage to communicate with the ink supply port, and the ink holding portion with the insertion shaft pulled out from the ink holding portion after inserted holds the ink near the ink supply port.

In the configuration described above, since the ink holding portion configured to hold the ink is provided in the inner plug pressed in the socket portion by the insertion shaft provided in the joint portion, the ink attached near the ink supply port can be held when the insertion shaft is pulled out from the ink holding portion. Dripping of the ink from the ink supply port of the socket main body can be thereby suppressed even when the joint portion repeatedly attached to and detached from the socket portion.

Moreover, the ink held in the ink holding portion of the inner plug can be prevented from dripping from the ink holding portion by a surface tension even when the ink cartridge is detached from the printing machine. Accordingly, the ink cartridge can be carried at ease.

Pulling out of the socket portion from the joint portion may include: sealing the ink passage by releasing the insertion shaft from pressing the ink holding portion; then releasing a fitting state between the joint portion and the socket portion; and then pulling out the insertion shaft from the ink holding portion.

In the configuration described above, the pulling out of the socket portion from the joint portion includes: sealing the ink passage by releasing the insertion shaft from pressing the ink holding portion; then releasing a fitting state between the joint portion and the socket portion; and then pulling out the insertion shaft from the ink holding portion. Since the insertion shaft is inserted into the ink holding portion at the time when the fitting state is released, a negative pressure is generated in the ink holding portion and/or a surface tension is generated between the ink holding portion and the ink when the insertion shaft is pulled out from the ink holding portion. Accordingly, it is possible to generate force which cancels spattering of the ink occurring when the fitting is released, and reduce the amount of the ink dripping from the ink insertion port.

The insertion shaft may be provided in a shape extending in a direction of an axis of the insertion shaft, and the ink holding portion may be a recess portion having a surface parallel to the axis of the insertion shaft.

In the configuration described above, the insertion shaft is provided in the shape extending in the axial direction, and the ink holding portion is the recess portion having the surface parallel to the axis of the insertion shaft. Accordingly, the dripping of the ink from the ink supply port in the direction of gravity can be suppressed even when the ink cartridge is installed while being inclined at about 2° in the printing machine.

DETAILED DESCRIPTION

Figure 1:
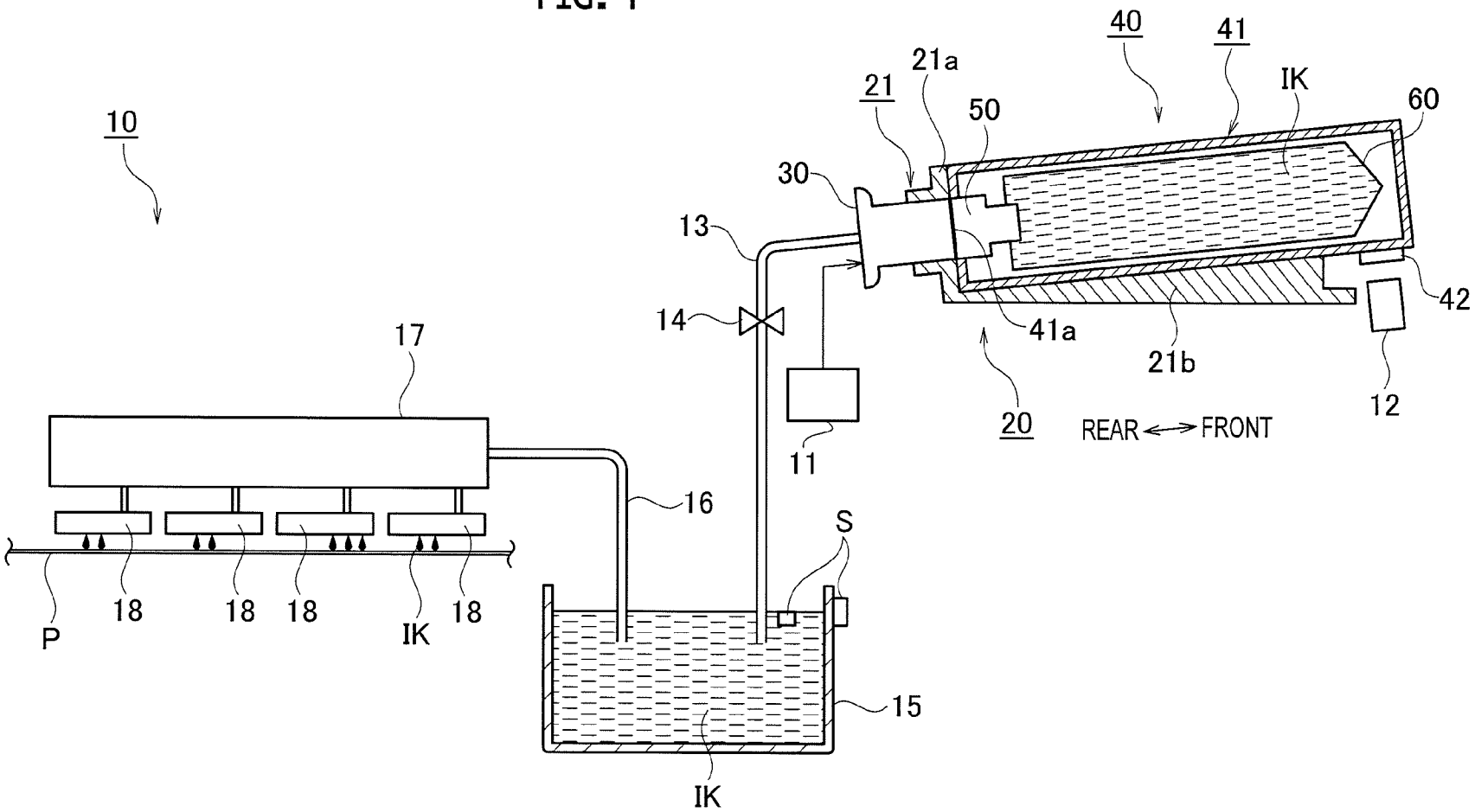
FIG. 1 is a configuration diagram showing a schematic configuration of an inkjet printing machine to which an ink cartridge in an embodiment of the present invention is applied.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Description will be hereinbelow provided for an embodiment of the present invention by referring to the drawings. It should be noted that the same or similar parts and components throughout the drawings will be denoted by the same or similar reference signs, and that descriptions for such parts and components will be omitted or simplified. In addition, it should be noted that the drawings are schematic and therefore different from the actual ones.

An ink cartridge in an embodiment of the present invention is described below in detail with reference to FIGS. 1 to 7F.

Before giving description of the ink cartridge in the embodiment of the present invention, an inkjet printing machine to which the ink cartridge 40 in the embodiment of the present invention is applied is briefly described by using FIG. 1.

FIG. 1 shows a schematic configuration of the inkjet printing machine to which the ink cartridge 40 is applied.

As shown in FIG. 1, in the inkjet printing machine (hereafter, simply referred to as printing machine) 10, a socket portion 50 provided in the ink cartridge 40 is detachably connected to a joint portion 30 supported by a holder 21 of a cartridge attachment mechanism 20 provided in the printing machine 10.

In this case, in the holder 21 of the cartridge attachment mechanism 20, a cartridge mounting table 21*b* is formed integrally with a front plate 21*a* to be continuously connected thereto. The ink cartridge 40 is mounted on the cartridge mounting table 21*b* while being inclined at about 2° so that an ink IK can flow toward the printing machine 10.

Moreover, as will be described later, the joint portion 30 supported by the front plate 21*a* of the holder 21 is driven in front-rear directions, i.e., directions toward and away from the socket portion 50 in the ink cartridge 40 by a cam drive mechanism 11 provided in the printing machine 10, after the ink cartridge 40 is connected to the cartridge attachment mechanism 20.

Meanwhile, in the ink cartridge 40, the socket portion 50 is disposed in a rectangular-solid outer case 41 to extend to a front surface 41*a* side of the outer case 41 and an ink storage container 60 storing the oil-based ink IK is attached to a rear end of the socket portion 50.

Moreover, an IC tag 42 is attached to the outer case 41 and an IC tag receiver 12 is installed in the printing machine 10 to face the IC tag 42. The IC tag receiver 12 can wirelessly receive color information and the like of the ink IK stored in the IC tag 42.

For example, multiple ink cartridges 40 respectively storing the inks IK of many colors such as yellow (Y), magenta (M), cyan (C), and black (K) are installed in the printing machine 10. However, illustration and description of only one ink cartridge 40 is given below.

The ink IK from the ink cartridge 40 described above is put into an ink tank 15 from the socket portion 50 through an ink supplementation passage 13 via the joint portion 30 of the printing machine 10, by an on-off operation of a solenoid on-off valve 14.

Moreover, the ink tank 15 is provided with a liquid level sensor S configured to measure the amount of the ink IK put into the ink tank 15. The on-off of the solenoid on-off valve 14 is controlled by a not-illustrated controller, depending on a detection result of the liquid level sensor S.

The supply of the ink IK from the ink cartridge 40 to the ink tank 15 is performed by using a pressure difference between the ink cartridge 40 disposed at a higher position and the ink tank 15 disposed at a lower position.

Thereafter, the ink IK put into the ink tank 15 is sent to an ink distributor 17 through an ink supply passage 16 and is distributed to multiple inkjet heads 18 by the ink distributor 17. Images and characters can be printed on a paper sheet P by ejecting the ink IK to the paper sheet P from the multiple inkjet heads 18.

Figure 2:
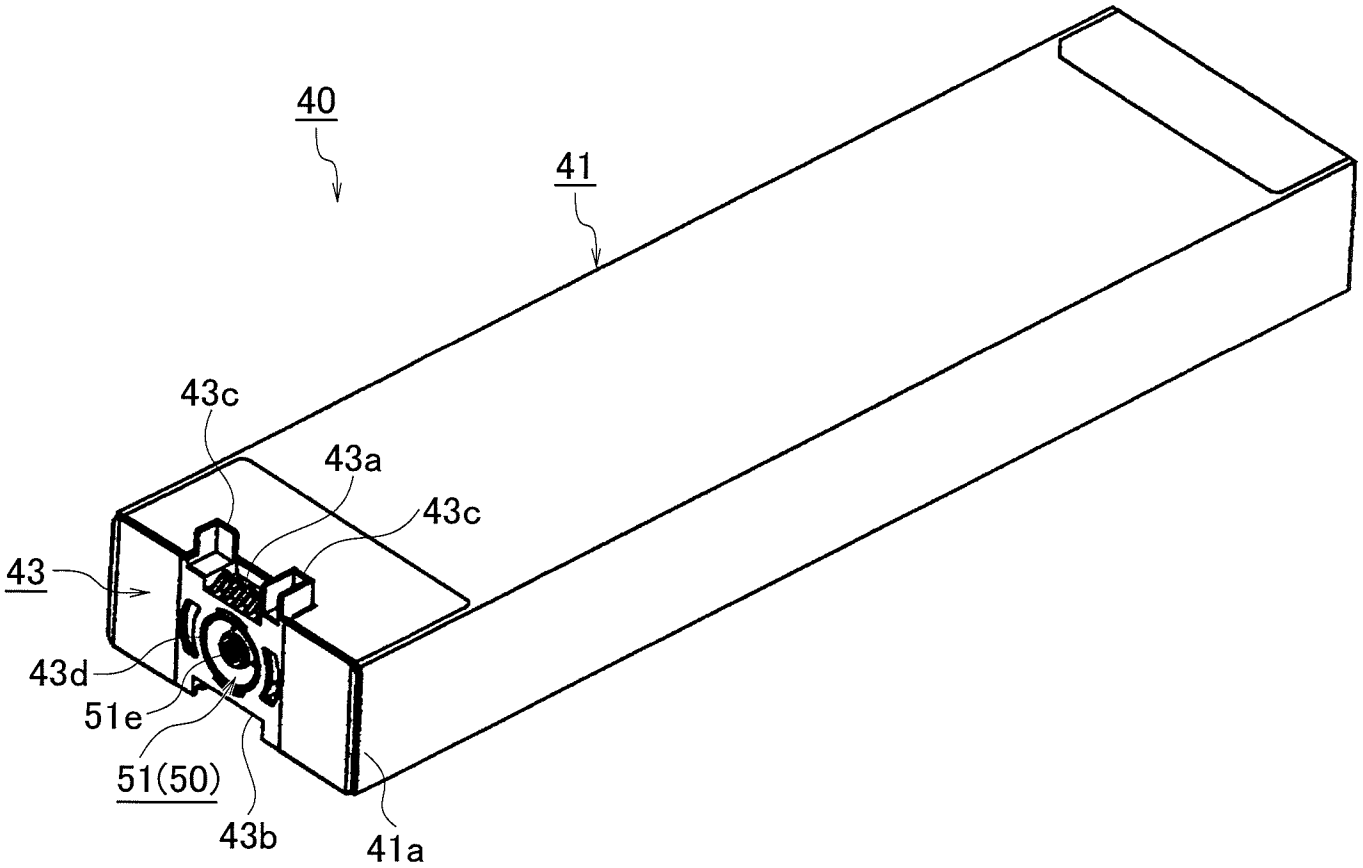
FIG. 2 is a perspective view showing an external shape of the ink cartridge in the embodiment of the present invention.
Figure 3A:
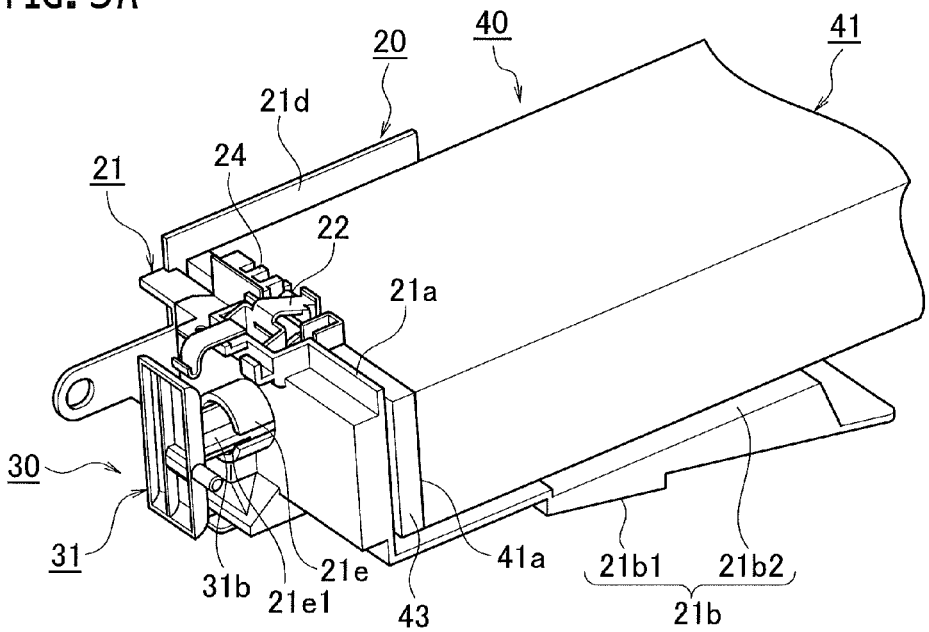
FIGS. 3A and 3B are a perspective view and a vertical cross-sectional view showing a state where the ink cartridge in the embodiment of the present invention is to be connected to a cartridge attachment mechanism in the printing machine.
Figure 3B:
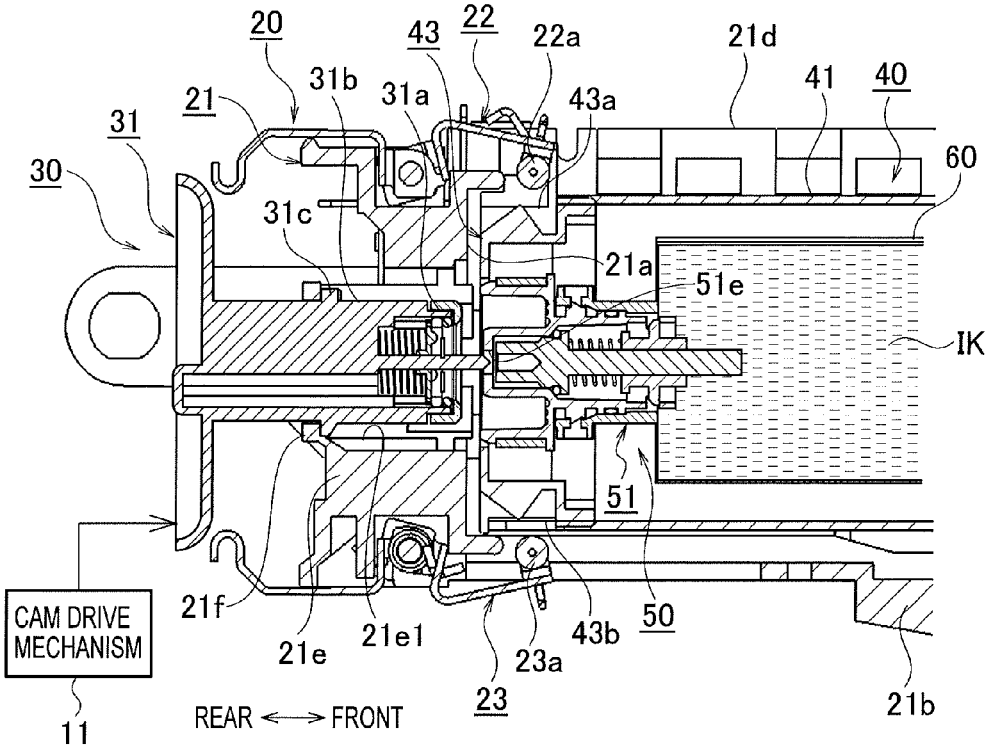
Figure 4:
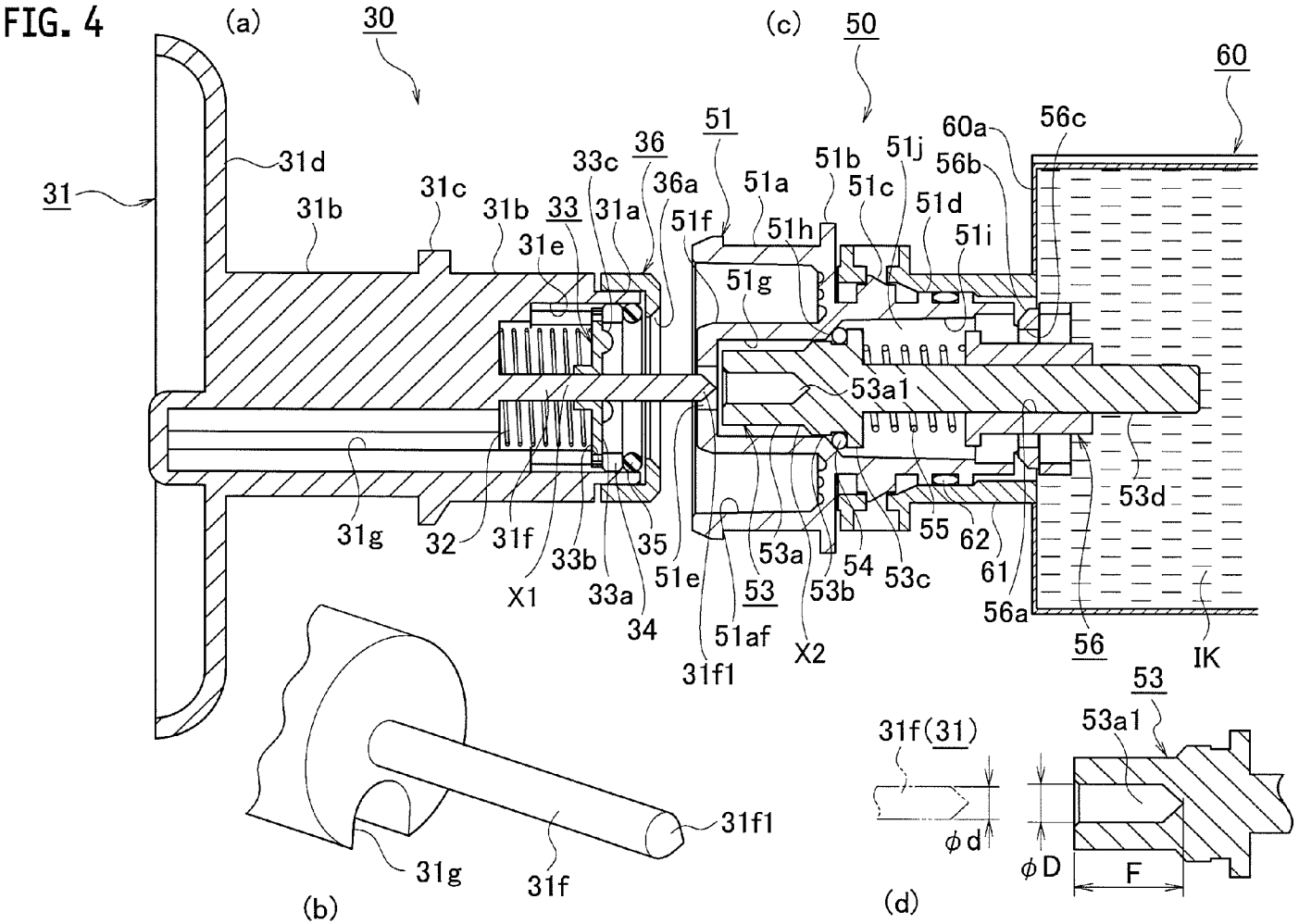
FIGS. 4(*a*) to 4(*d*) are views showing, in an enlarged manner, a joint portion in the printing machine and a socket portion in the ink cartridge to be fitted to the joint portion.

Here, a configuration of the ink cartridge 40 is described by using FIG. 2 to FIG. 4(*d*).

FIG. 2 shows a perspective view of an external shape of the ink cartridge 40. Moreover, FIGS. 3A and 3B show a state where the ink cartridge 40 is to be connected to the cartridge attachment mechanism in the printing machine. Furthermore, FIGS. 4(*a*) to 4(*d*) show, in an enlarged manner, the joint portion in the printing machine and the socket portion in the ink cartridge 40 to be fitted to the joint portion. FIG. 4(*c*) is an enlarged view of an X1 portion in FIG. 4(*a*) and FIG. 4(*d*) is an enlarged view of an X2 portion in FIG. 4(*b*).

First, as shown in FIG. 2, in the ink cartridge 40, the outer case 41 is formed by using a paper material or the like, in a box shape with a ratio between a vertical dimension in a vertical direction and a horizontal dimension in a horizontal direction being set to about 1:2.

Furthermore, a connection member 43 made of a stiff plate material such as a resin material or a metal material is attached to the front surface 41*a* side of the outer case 41 and thereby is unified with the outer case 41.

The connection member 43 described above has a function of connecting the ink cartridge 40 to the printing machine 10 (FIG. 1) and a function of connecting the socket portion 50 in the ink cartridge 40.

Lock recess portions 43*a*, 43*b* configured to be connected to the cartridge attachment mechanism 20 of the printing machine 10 (FIG. 1) are formed in center portions of upper and lower outer sides of the connection member 43.

Furthermore, a pair of protruding portions 43*c*, 43*c* are formed to protrude respectively on both sides of the lock recess portion 43*a* in the upper outer side of the connection member 43. The pair of protruding portions 43*c*, 43*c* are detected by a cartridge attachment sensor 24 (FIG. 3A) attached to an upper portion of the front plate 21*a* of the holder 21.

Moreover, a center portion of the connection member 43 is provided with a round hole 43*d* formed to penetrate the connection member 43. The socket portion 50 is inserted in the round hole 43*d* in a manner visible from outside, and a later-described ink supply port 51*e* formed in a socket main body 51 of the socket portion 50 is exposed toward the printing machine 10 (FIG. 1) side.

The ink supply port 51*e* described above is configured such that the ink supply port 51*e* is opened to have a large diameter of, for example, about ϕ3 mm and that a large amount of the ink IK can be supplied to the printing machine 10 (FIG. 1) side from the ink supply port 51*e* formed to have a large diameter.

In the ink cartridge 40, the socket portion 50 is disposed to face the joint portion 30 (FIG. 1) in the printing machine 10 (FIG. 1). Moreover, the ink storage container 60 (FIG. 3B) formed in a bag shape by using a film material is attached to a rear portion of the socket main body 51 of the socket portion 50 by heat sealing. The socket portion 50 is thus provided at one end of the ink storage container 60 which is a front end.

Next, as shown in FIGS. 3A and 3B, in a case where the ink cartridge 40 is connected to the cartridge attachment mechanism 20 in the printing machine 10 (FIG. 1) of the ink cartridge 40, in the cartridge mechanism 20, the holder 21 which is a base made of a resin material is formed as a frame body with stiffness integrally including: the substantially-vertical front plate 21*a*; the cartridge mounting table 21*b* horizontally provided to be continuously connected to a lower portion of the front plate 21*a*; and a pair of left and right side plates (21*c*, not illustrated), 21*d* vertically provided to be continuously connected to left and right portions of the front plate 21*a*.

In a center portion of the front plate 21*a* of the holder 21 described above, an annular portion 21*e* having a through hole 21*e*1 with guide grooves is formed to protrude toward a rear side which is the opposite side to the ink cartridge 40 side.

Moreover, first and second outer periphery cylinder portions 31*a*, 31*b* formed in a joint main body 31 of the joint portion 30 are fitted into and supported by the through hole 21*e*1 with guide grooves of the annular portion 21*e* of the holder 21 to be slidable in the front-rear directions.

In this case, a stopper 21*f* configured to prevent the joint portion 30 from falling out from the through hole 21*e*1 with guide grooves of the annular portion 21*e* is provided integrally in a rear end of the annular portion 21*e* of the holder 21. An outer periphery protruding portion 31*c* formed in the joint main body 31 which will be described later is brought into contact with and moved away from the stopper 21*f*.

Moreover, in the cartridge mounting table 21*b* of the holder 21, a bottom surface 21*b*1 is formed to be horizontal and an inclined surface 21*b*2 is formed above the bottom surface 21*b*1 to be inclined at about 2° in such a way that the height of the inclined surface 21*b*2 becomes lower toward the front plate 21*a* side.

When the ink cartridge 40 is mounted on the inclined surface 21*b*2 of the cartridge mounting table 21*b*, the ink IK in the ink cartridge 40 flows toward the joint portion 30.

Furthermore, lock members 22, 23 which are formed by attaching rollers 22*a*, 23*a* respectively to one ends of flat spring materials and which elastically deform are provided in upper and lower portions of the holder 21. The lock recess portions 43*a*, 43*b* are formed in upper and lower portions of the connection member 43 to face the lock members 22, 23, the connection member 43 provided on the front surface 41*a* side of the outer case 41 of the ink cartridge 40.

The ink cartridge 40 is connected by being manually pushed toward the holder 21 of the cartridge attachment mechanism 20. At this time, the rollers 22*a*, 23*a* of the lock members 22, 23 provided in the upper and lower portions of the holder 21 are fitted into the lock recess portions 43*a*, 43*b* of the connection member 43 provided in the ink cartridge 40. Accordingly, the ink cartridge 40 is connected to the holder 21 and the connection state of the ink cartridge 40 is detected by using the cartridge attachment sensor 24 attached to the upper portion of the holder 21 and the protruding portion 43*c* (FIG. 2) of the connection member 43.

Meanwhile, when the ink cartridge 40 is manually pulled out from the holder 21, the connection with the holder 21 is released.

Furthermore, as will be described in the below-mentioned operation, when the ink cartridge 40 is pushed toward the holder 21 of the cartridge attachment mechanism 20 and is thereby connected to the holder 21, the joint portion 30 and the socket portion 50 face each other with a small gap therebetween. After the connection, the joint portion 30 can be moved in front-rear directions, i.e., in directions toward and away from the socket portion 50 in the ink cartridge 40 by the cam drive mechanism 11 provided in the printing machine 10 (FIG. 1).

Due to this configuration, the joint portion 30 and the socket portion 50 are fitted to each other only in the case where the ink cartridge 40 and the holder 21 are already connected to each other.

The reason for this is as follows. As described above by using FIG. 1, the joint portion 30 needs to be fitted to the socket portion 50 after the color information of the ink IK outputted from the IC tag 42 attached to the outer case 41 of the ink cartridge 40 is received by the IC tag receiver 12 and the color of the ink IK of the ink cartridge 40 is checked to be correct.

Here, in a case where the joint portion 30 formed in a plug shape is referred to as a male plug portion while the socket portion 50 formed in a socket shape is referred to as a female socket portion, the male plug portion (30) and the female socket portion (50) are male-female matched to each other.

By using FIGS. 4(*a*) to 4(*d*), description is given of the joint portion 30 in the printing machine 10 and the socket portion 50 in the ink cartridge 40 which form a main portion of the embodiment.

(Joint Portion 30)

As shown in FIGS. 4(*a*) and 4(*b*), in the joint portion 30 provided in the printing machine 10, a side of a cap 36 attached to a outer periphery of a distal end of the joint main body 31 is configured as a side to be fitted to the socket portion 50 provided in the ink cartridge 40 to be described later.

Moreover, the joint main body 31 which is a base body of the joint portion 30 is formed integrally by using a resin material.

In the joint main body 31 described above, the first outer periphery cylinder portion 31*a* is formed in a distal end portion facing the socket portion 50 in the ink cartridge 40. The first outer periphery cylinder portion 31*a* is formed to have such a diameter and a length that the cap 36 can be attached thereto. Moreover, the second outer periphery cylinder portion 31*b* is formed behind the first outer periphery cylinder portion 31*a* to be continuously connected thereto. The second outer periphery cylinder portion 31*b* is formed to have a long length and a diameter larger than that of the first outer periphery cylinder portion 31*a* and about the same as the outer diameter of the cap 36.

Moreover, in the joint main body 31, the outer periphery protruding portion 31*c* having a short length is formed to protrude outward in an intermediate portion of the second outer periphery cylinder portion 31*b* having the long length. In addition, a flange portion 31*d* is formed at a rear end of the second outer periphery cylinder portion 31*b*, in a rectangular shape extending vertically to the second outer periphery cylinder portion 31*b* as shown in FIG. 3A.

In this case, when the first and second outer periphery cylinder portions 31*a*, 31*b* of the joint main body 31 are moved in the front-rear directions in the through hole 21*e*1 with guide grooves of the annular portion 21*e* of the holder 21 by drive force of the cam drive mechanism 11 as shown in FIG. 3B mentioned above, the outer periphery protruding portion 31*c* formed in the intermediate portion of the second outer periphery cylinder portion 31*b* functions as a rotation stopper and a movement stopper.

Returning to FIGS. 4(*a*) and 4(*b*), a distal end circular recess portion 31*e* is formed in an inner peripheral portion of the distal end of the joint main body 31 to be recessed in a circular recess shape. In addition, an insertion shaft 31*f* is formed in a center portion of the distal end circular recess portion 31*e* to protrude forward beyond the cap 36, in a shape extending in an axial direction.

The aforementioned insertion shaft 31*f* formed to protrude to the distal end side of the joint main body 31 is formed to face the ink supply port 51*e* of the socket main body 51 to be described later and to have a diameter smaller than a hole diameter of the ink supply port 51*e*. Accordingly, the ink IK is supplied from the ink supply port 51*e* of the socket main body 51 into the joint main body 31.

Moreover, a distal end sharp portion 31*f*1 is formed at a distal end of the insertion shaft 31*f* of the joint main body 31, in a conical shape. The shape of the distal end sharp portion 31*f*1 is such that the distal end sharp portion 31*f*1 can be easily advanced into and retreated from an ink holding portion 53*a*1 of an inner plug 53 to be described later after being inserted into the ink supply port 51*e* of the socket main body 51, the inner plug 53 being housed in the socket main body 51.

Moreover, an ink flow-in passage 31*g* into which the ink IK supplied from the socket main body 51 flows is formed throughout a portion of the joint main body 31 behind and under the insertion shaft 31*f* to continuously extend to the flange portion 31*d*.

Due to the configuration described above, an annular (ring shaped) space is formed between an inner peripheral surface of the distal end circular recess portion 31*e* of the joint main body 31 and an outer peripheral surface of the insertion shaft 31*f* with a small diameter.

Furthermore, a compression spring 32, an ink leakage preventing member 33 provided to be capable of reciprocating along the insertion shaft 31*f*, an O-ring holding member 34, and an O-ring 35 are housed inside the annular (ring shaped) space in the distal end circular recess portion 31*e* of the joint main body 31 in this order from the rear side to the distal end side, with the insertion shaft 31*f* passing through these members 32 to 35.

These members 32 to 35 are formed such that the ink IK supplied from the ink cartridge 40 can be made to flow to the ink flow-in passage 31*g* of the joint main body 31.

Specifically, in the ink leakage preventing member 33 movable along the insertion shaft 31*f*, a circular plate portion 33*a* is formed to have substantially the same diameter as an inner diameter of the distal end circular recess portion 31*e* of the joint main body 31, and multiple ink flow-in holes 33*b* are formed in an outer peripheral portion of the circular plate portion 33*a* to penetrate the circular plate portion 33*a*. In addition, three protrusions 33*c* are formed on a front side of the circular plate portion 33*a* at intervals of 120° in a circumferential direction to protrude toward the ink supply port 51*e* of the socket main body 51.

Moreover, when the joint portion 30 and the socket portion 50 are fitted to each other, the ink leakage preventing member 33 described above faces an outer surface of the socket main body 51 forming the ink supply port 51*e*. Furthermore, the three protrusions 33*c* come into contact with the outer surface forming the ink supply port 51*e* while portions of the ink leakage preventing member 33 other than the three protrusions 33*c* do not come into contact with the outer surface.

When the joint portion 30 and the socket portion 50 are fitted to each other, the ink IK from the ink supply port 51*e* flows into a gap formed between the portions other than the three protrusions 33*c* and the outer surface forming the ink supply port 51*e*. This ink IK passes through the multiple ink flow-in holes 33*b* formed in the circular plate portion 33*a* of the ink leakage preventing member 33 and eventually flows to the ink flow-in passage 31*g*.

Accordingly, the ink leakage preventing member 33 has a function of preventing the ink I entering a space on the rear side of the ink leakage preventing member 33 through the multiple ink flow-in holes 33*b* from leaking to the socket main body 51 side.

Furthermore, attaching the cap 36 having a large-diameter circular hole 36*a* formed in a center portion to the first outer periphery cylinder portion 31*a* of the joint main body 31 causes the members 32 to 35 housed in the distal end circular recess portion 31*e* to be enclosed by the cap 36. However, as will be described later, the ink supply port 51*e* side of the socket main body 51 of the socket portion 50 can advance into and retreat from the distal end circular recess portion 31*e* and the large-diameter circular hole 36*a* of the cap 36.

(Socket Portion 50)

As shown in FIGS. 4(*c*) and 4(*d*), the socket portion 50 provided in the ink cartridge 40 is formed such that a side of an inner periphery cylinder portion 51*f* and a distal end annular recess portion 51*af* which are formed on a distal end side of the socket main body 51 is configured as a side to be fitted to the joint portion 30 provided in the printing machine 10.

Moreover, the socket main body 51 which is a base body of the socket portion 50 is formed integrally by using a resin material, like the joint main body 31.

In the socket main body 51 described above, an outer periphery large-diameter cylinder portion 51*a* is formed at a distal end portion of the socket main body 51 which faces the joint main body 31 of the joint portion 30, the outer periphery large-diameter cylinder portion 51*a* formed to have a diameter larger than those of the first and second outer periphery cylinder portions 31*a*, 31*b* of the joint main body 31 and to have a length large enough to house distal end portions of the first and second outer periphery cylinder portions 31*a*, 31*b*.

Moreover, in the socket main body 51, an outer periphery circular protruding portion 51*b* is formed behind the outer periphery large-diameter cylinder portion 51*a* to be continuously connected thereto and to have a larger diameter and a smaller length than the outer periphery large-diameter cylinder portion 51*a*. Furthermore, an outer periphery tapered cylinder portion 51*c* is formed behind the outer periphery circular protruding portion 51*b* to be continuously connected thereto and to have a small length and an outer diameter which gradually becomes smaller toward a rear end side.

Furthermore, in the socket main body 51, an outer periphery small-diameter cylinder portion 51*d* is formed behind the outer periphery tapered cylinder portion 51*c* to be continuously connected thereto and to extend to a position near a front surface 60*a* of the ink storage container 60.

Moreover, in the socket main body 51, the inner periphery cylinder portion 51*f* having the ink supply port 51*e* with a diameter larger than the diameter of the insertion shaft 31*f* opened on a distal end surface is formed to be capable of advancing into and retreating from the large-diameter circular hole 36*a* of the cap 36 and the distal end circular recess portion 31*e* of the joint main body 31.

Furthermore, the insertion shaft 31*f* formed in the joint main body 31 can advance into and retreat from the ink supply port 51*e* while the distal end annular recess portion 51*af* having the annular (ring-shaped) space is formed on the distal end side between the inner peripheral surface of the outer periphery large-diameter cylinder portion 51*a* and the outer peripheral surface of the inner periphery cylinder portion 51*f* to have a recess shape.

Moreover, a first circular recess portion 51*g*, a tapered recess portion 51*h*, and a second circular recess portion 51*i* are formed in a step shape in this order from a rear side of the ink supply port 51*e* of the socket main body 51 toward the rear end of the socket main body 51, in such a way that the inner diameters of these portions become larger.

Moreover, the inner plug 53 housed in the first circular recess portion 51*g*, the tapered recess portion 51*h*, and the second circular recess portion 51*i* of the socket main body 51 is integrally formed of: a first cylinder portion 53*a* facing the ink supply port 51*e* of the socket main body 51; a second cylinder portion 53*b* formed behind the first cylinder portion 53*a* to be continuously connected thereto and having a diameter larger than the first cylinder portion 53*a*; a circular protruding portion 53*c* formed behind the second cylinder portion 53*b* to be continuously connected thereto and having a diameter larger than the second cylinder portion 53*b*; and a small-diameter shaft portion 53*d* formed behind the circular protruding portion 53*c* to be continuously connected thereto and having a small diameter and a long length.

Furthermore, the ink holding portion 53*a*1 where the insertion shaft 31*f* of the joint main body 31 is inserted and removed is formed as a bottomed hole in a distal end surface center portion of the first cylinder portion 53*a* of the inner plug 53.

As shown in FIG. 4(*d*), the ink holding portion 53*a*1 is formed to have a hole diameter $\phi D$ which is slightly larger than a shaft diameter $\phi d$ of the insertion shaft 31*f* ($\phi D > \phi d$) and to have a predetermined depth F.

The aforementioned ink holding portion 53*a*1 formed on the distal end side of the inner plug 53 is a main portion of the embodiment. As will be explained in the operation to be described later, when the joint main body 31 is fitted to the socket main body 51, the insertion shaft 31*f* of the joint main body 31 is inserted into the ink holding portion 53*a*1 and the distal end sharp portion 31*f*1 of the insertion shaft 31*f* presses the inner plug 53 rearward.

Moreover, when the insertion shaft 31*f* inserted into the ink holding portion 53*a*1 is pulled out, the ink holding portion 53*a*1 can suck and hold the ink IK existing near the ink supply port 51*e* of the socket main body 51.

Moreover, an O-ring 54 is fitted from the first and second cylinder portions 53*a*, 53*b* side of the inner plug 53 and brought into contact with the circular protruding portion 53*c*.

Furthermore, after a compression spring 55 is fitted to the small-diameter shaft portion 53*d* of the inner plug 53, the small-diameter shaft portion 53*d* is fitted to a shaft hole 56*a* of a bearing member 56. The bearing member 56 is fixedly supported between the inner side of the second circular recess portion 51*i* of the socket main body 51 and the front surface 60*a* of the ink storage container 60. In this case, an ink flow-in hole 56*c* allowing the ink IK in the ink storage container 60 to flow into the second circular recess portion 51*i* is formed to penetrate a flange portion 56*b* of the bearing member 56.

When the ink cartridge 40 is not used, the inner plug 53 moves toward the ink supply port 51*e* of the socket main body 51 by biasing force of the compression spring 55. At this time, since the O-ring 54 fitted to the second cylinder portion 53*b* of the inner plug 53 is in contact with the circular protruding portion 53*c* of the inner plug 53 and the tapered recess portion 51*h* of the socket main body 51, an ink flow-out passage 51*j* formed in the second circular recess portion 51*i* is closed. Accordingly, the ink IK in the ink storage container 60 is prevented from flowing out to the ink supply port 51*e*.

Moreover, since a container supporting cylinder body 61 attached to the front surface 60*a* of the ink storage container 60 is fitted to a rear end outer peripheral portion of the socket main body 51 via an O-ring 62, ink leakage is also prevented between the socket main body 51 and the ink storage container 60.

Next, operations of the ink cartridge 40 configured as described above are described by also using FIGS. 1 to 6(*d*), in the order of an operation sequence.

Figure 5:
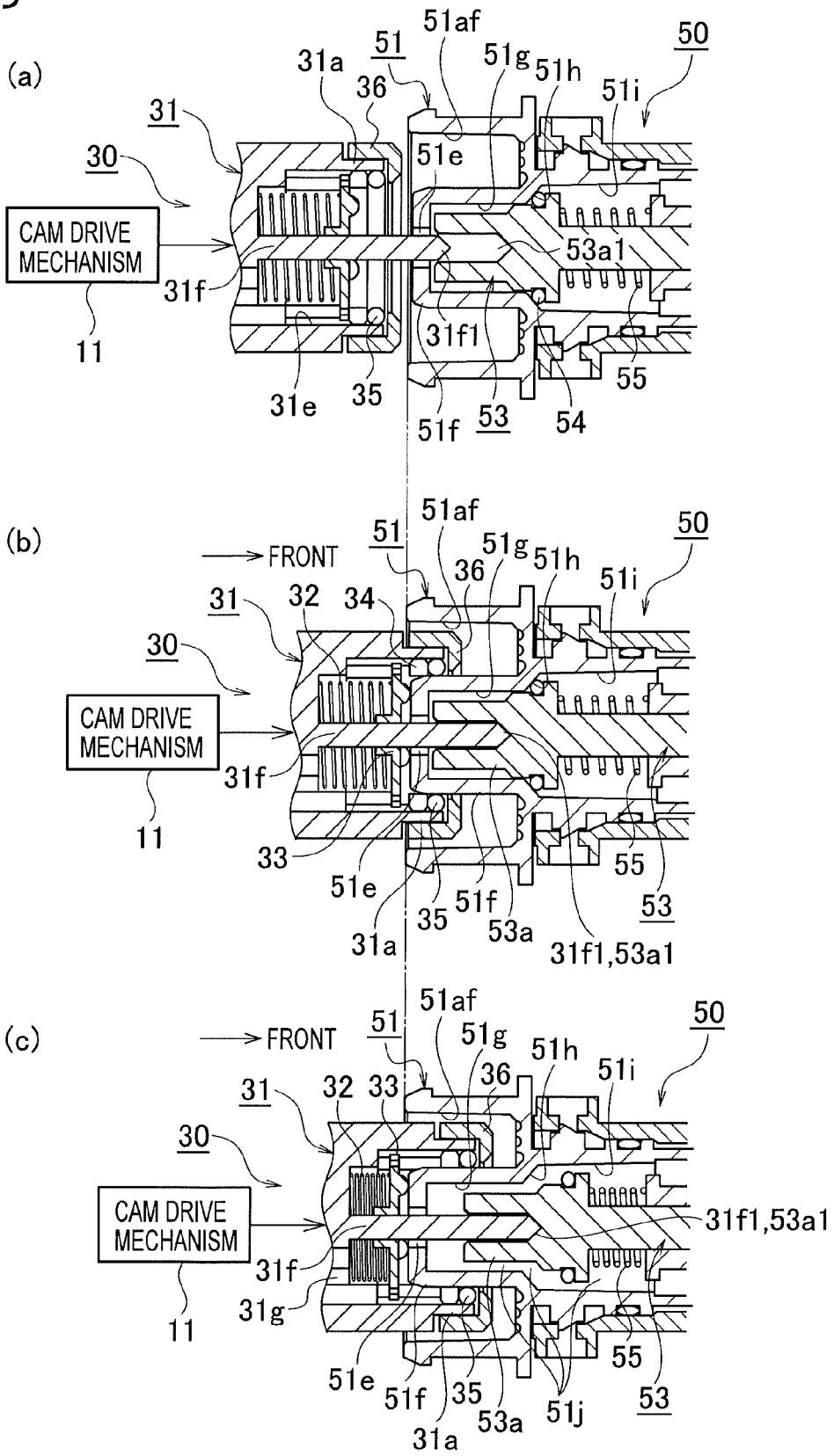
FIGS. 5(*a*) to 5(*c*) are operation views showing an operation sequence of fitting the socket portion of the ink cartridge to the joint portion in the printing machine.

FIGS. 5(*a*) to 5(*c*) show an operation sequence of fitting the socket portion of the ink cartridge to the joint portion in the printing machine. Moreover, FIGS. 6(*a*) to 6(*d*) show an operation sequence of pulling the joint portion in the printing machine out from the socket portion of the ink cartridge.

(Operations of Fitting Socket Portion 50 to Joint Portion 30)

First, FIG. 5(*a*) shows a state just after the ink cartridge 40 is connected to the holder 21 fixedly disposed in the cartridge attachment mechanism 20 and before the joint portion 30 supported by the holder 21 to be movable in the front-rear directions is fitted to the socket portion 50.

In this case, the state where the joint portion 30 is fitted to the socket portion 50 is a state where the cap 36 side of the joint portion 30 enters the distal end annular recess portion 51*af* of the socket main body 51 and the O-ring 35 provided in the joint main body 31 is in sliding contact with the inner periphery cylinder portion 51*f* formed on an inner peripheral distal end side of the socket main body 51. Accordingly, the state of FIG. 5(*a*) is a state before the fitting because the O-ring 35 is spaced away from the inner periphery cylinder portion 51*f*.

Then, when the ink cartridge 40 is connected to the holder 21, the IC tag receiver 12 provided in the printing machine 10 receives the color information of the ink IK from the IC tag 42 attached to the outer case 41 of the ink cartridge 40 and the not-illustrated controller determines whether the color corresponding to the color information of the ink IK matches the holder 21 to which the ink cartridge 40 is attached. Accordingly, an error of ink color can be detected first.

Moreover, the joint portion 30 of the printing machine 10 and the socket portion 50 of the ink cartridge 40 face each other with a small gap provided therebetween. In addition, the cam drive mechanism 11 configured to move the joint portion 30 toward the socket portion 50 is stopped and is set to a standby state.

Specifically, on the joint portion 30 side, the insertion shaft 31*f* formed in the center portion of the inside of the distal end circular recess portion 31*e* of the joint main body 31 protrudes forward beyond the cap 36 attached to the first outer periphery cylinder portion 31*a* of the joint main body 31.

Meanwhile, on the socket portion 50 side, in the first circular recess portion 51*g*, the tapered recess portion 51*h*, and the second circular recess portion 51*i* of the socket main body 51, the inner plug 53 to which the O-ring 54 is fitted is moved toward the ink supply port 51*e* on the front side by the biasing force of the compression spring 55 and plugs the ink supply port 51*e*.

Furthermore, the insertion shaft 31*f* of the joint main body 31 enters the ink supply port 51*e* of the socket main body 51 of the socket portion 50 and the distal end sharp portion 31*f*1 of the insertion shaft 31*f* faces the ink holding portion 53*a*1 of the inner plug 53 moved forward in the first circular recess portion 51*g* of the socket main body 51.

Next, FIG. 5(*b*) shows a state just before the insertion shaft 31*f* of the joint main body 31 pushes the inner plug 53 in the socket main body 51 rearward.

In this state, the cam drive mechanism 11 is activated to move the joint portion 30 forward toward the socket portion 50. Then, the side of the cap 36 attached to the first outer periphery cylinder portion 31*a* of the joint main body 31 enters the distal end annular recess portion 51*af* formed on the distal end side of the socket main body 51.

Along with this, the ink supply port 51*e* side of the socket main body 51 moves into the cap 36, the O-ring 35, and the O-ring holding member 34 in the joint main body 31 in this order. Accordingly, the three protrusions 33*c* (FIG. 4(*a*)) formed in the ink leakage preventing member 33 are brought into contact with the outer surface of the socket main body 51 forming the ink supply port 51*e*, by the biasing force of the compression spring 32 in the joint main body 31.

At the same time, the insertion shaft 31*f* of the joint main body 31 is inserted into the ink holding portion 53*a*1 of the inner plug 53 moved forward in the first circular recess portion 51*g* of the socket main body 51.

Then, the distal end sharp portion 31*f*1 of the insertion shaft 31*f* of the joint main body 31 is brought in contact with a bottom portion of the ink holding portion 53*a*1 formed in the first cylinder portion 53*a* of the inner plug 53. However, since the inner plug 53 is not moved rearward yet, the ink IK in the socket main body 51 is sealed by the inner plug 53.

Next, FIG. 5(*c*) shows a state where the insertion shaft 31*f* of the joint main body 31 pushes the inner plug 53 in the socket main body 51 rearward.

In this state, the cam drive mechanism 11 is continuously operated from the state of FIG. 5(*b*) to further move the joint portion 30 toward the socket portion 50. As a result, the side of the cap 36 attached to the first outer periphery cylinder portion 31*a* of the joint main body 31 enters deep into the distal end annular recess portion 51*af* formed on the distal end side of the socket main body 51.

Along with this, the outer surface of the socket main body 51 forming the ink supply port 51*e* pushes the three protrusions 33*c* (FIG. 4 (*a*)) formed in the ink leakage preventing member 33 in the joint main body 31 rearward. The compression spring 32 in the joint main body 31 is thereby compressed.

Then, the distal end sharp portion 31*f*1 of the insertion shaft 31*f* of the joint main body 31 pushes the ink holding portion 53*a*1 of the inner plug 53 housed in the socket main body 51 to the opposite side to the ink supply port 51*e*, against the compression spring 55. The ink flow-out passage 51*j* is thus formed in the first circular recess portion 51*g*, the tapered recess portion 51*h*, and the second circular recess portion 51*i* of the socket main body 51.

Furthermore, since the inner periphery cylinder portion 51*f* of the socket main body 51 is brought into contact with an inner peripheral surface of the O-ring 35 housed in the joint main body 31, ink leakage in the joint main body 31 can be prevented.

Due to this, the ink IK in the socket main body 51 flows through the ink flow-out passage 51*j* formed in the socket main body 51, enters the joint main body 31 from the ink supply port 51*e*, and is supplied to the printing machine 10 side through the ink flow-in passage 31*g* formed in the joint main body 31.

(Operations of Pulling Joint Portion 30 Out from Socket Portion 50)

Figure 6:
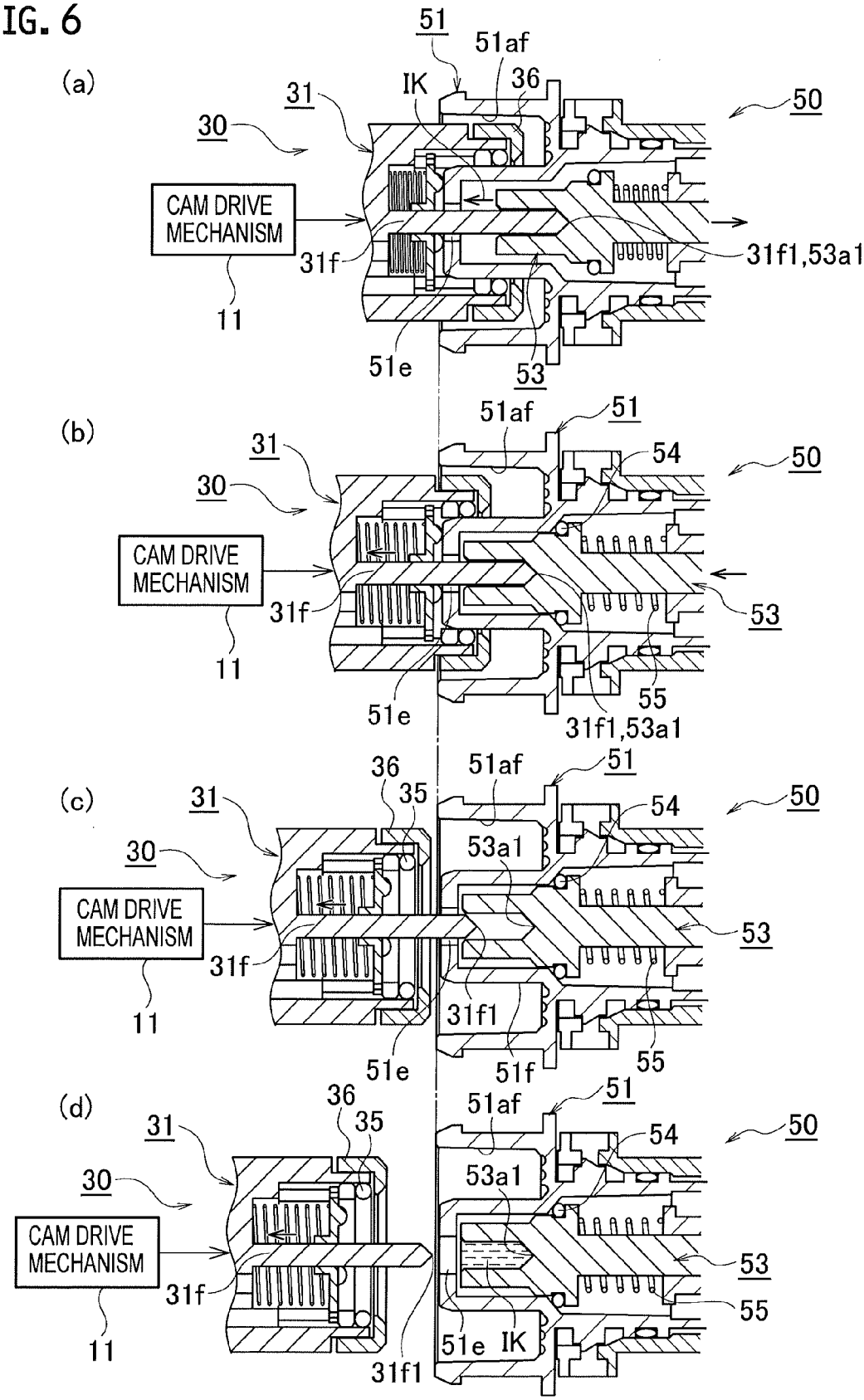
FIGS. 6(*a*) to 6(*d*) are operation views showing an operation sequence of pulling the joint portion in the printing machine out from the socket portion of the ink cartridge.

When the joint portion 30 in the printing machine 10 is to be pulled out from the socket portion 50 in the ink cartridge 40, it only necessary to perform the operations of FIGS. 5(*a*) to 5(*c*) described above in the reverse order of FIGS. 5(*c*) to 5(*a*), and these operations are described by using FIGS. 6(*a*) to 6(*d*).

First, the state shown in FIG. 6(*a*) is the same as the state shown in FIG. 5(*c*) described above. The cap 36 side of the joint portion 30 has entered deep into the distal end annular recess portion 51*af* of the socket main body 51 and the joint portion 30 is fitted to the socket portion 50.

At this time, the distal end sharp portion 31*f*1 of the insertion shaft 31*f* of the joint main body 31 is in contact with the bottom portion of the ink holding portion 53*a*1 of the inner plug 53 moved rearward in the socket main body 51. Moreover, since the inner plug 53 is moved rearward, the ink supply port 51*e* of the socket main body 51 is opened. Accordingly, the ink IK in the socket main body 51 is supplied into the joint main body 31 through the ink supply port 51*e*.

Next, in a state shown in FIG. 6(*b*), the cam drive mechanism 11 is operated in such a direction (direction of the arrow) that the insertion shaft 31*f* of the joint main body 31 is pulled out from the ink holding portion 53*a*1 of the inner plug 53, and the insertion shaft 31*f* is thereby released from pressing of the inner plug 53. However, the joint portion 30 is retreated toward the front side in the distal end annular recess portion 51*af* of the socket main body 51 while being fitted to the socket portion 50.

Then, the inner plug 53 to which the O-ring 54 is fitted follows the pulling-out of the insertion shaft 31*f* of the joint main body 31 and moves forward in the socket main body 51 by the biasing force of the compression spring 55 to plug the ink supply port 51*e*, thereby sealing the ink flow-out passage 51*j*.

At this time, the distal end sharp portion 31*f*1 of the insertion shaft 31*f* of the joint main body 31 is still in contact with the bottom portion of the ink holding portion 53*a*1 of the inner plug 53 due to the biasing force of the compression spring 55.

Next, in a state shown in FIG. 6(*c*), when the cam drive mechanism 11 is continuously operated from the state of FIG. 6(*b*), the insertion shaft 31*f* of the joint main body 31 is moved in such a direction (direction of the arrow) that the insertion shaft 31*f* is further pulled out from the ink holding portion 53*a*1 of the inner plug 53, and the fitting between the joint portion 30 and the socket portion 50 is released.

Here, since the inner plug 53 has already moved forward in the socket main body 51, the inner plug 53 is stopped.

Meanwhile, due to the movement of the joint portion 30 in the direction of the arrow, the cap 36 side of the joint portion 30 is moved out from the distal end annular recess portion 51*af* of the socket main body 51 and the O-ring 35 provided in the joint main body 31 is spaced away from the inner periphery cylinder portion 51*f* formed on the inner peripheral distal end side of the socket main body 51. The fitting between the joint portion 30 and the socket portion 50 is thereby released.

At this time, the distal end sharp portion 31*f*1 of the insertion shaft 31*f* of the joint main body 31 is retreated to the front side of the ink holding portion 53*a*1 of the inner plug 53 but does not get out of the ink holding portion 53*a*1 yet.

Next, in a state shown in FIG. 6(*d*), the cam drive mechanism 11 is further continuously operated from the state shown in FIG. 6(*c*) to move the insertion shaft 31*f* of the joint main body 31 in such a direction (direction of the arrow) that the insertion shaft 31*f* is further pulled out from the ink holding portion 53*a*1 of the inner plug 53. The insertion shaft 31*f* of the joint main body 31 is thereby completely pulled out from the ink holding portion 53*a*1 of the inner plug 53.

Here, as described in FIG. 6(*c*), the ink flow-out passage 51*j* in the socket main body 51 is sealed. Moreover, when the insertion shaft 31*f* of the joint main body 31 is pulled out from the state where the insertion shaft 31*f* is inserted into the ink holding portion 53*a*1 of the inner plug 53, a negative pressure is generated in the ink holding portion 53*a*1 and/or a surface tension is generated between the ink holding portion 53*a*1 and the ink IK. Accordingly, it is possible to generate force which cancels spattering of the ink IK occurring when the fitting between the joint portion 30 and the socket portion 50 is released.

In this case, as described above, the shaft diameter ϕd (FIG. 4(*d*)) of the insertion shaft 31*f* of the joint main body 31 is set to be smaller than the hole diameter ϕD (FIG. 4(*d*)) of the ink holding portion 53*a*1 of the inner plug 53. An effect of the negative pressure becomes larger as the gap between the insertion shaft 31*f* and the ink holding portion 53*a*1 becomes smaller while an effect of the surface tension becomes larger as the gap between the insertion shaft 31*f* and the ink holding portion 53*a*1 becomes larger.

Due to this, the ink IK near the ink supply port 51*e* of the socket main body 51 is sucked into and held in the ink holding portion 53*a*1. Accordingly, it is possible to suppress dripping of the ink IK from the ink supply port 51*e* of the socket main body 51 even when the joint portion 30 is repeatedly attached to and detached from the socket portion 50.

Moreover, even when the ink cartridge 40 is detached from the printing machine 10, the ink IK held in the ink holding portion 53*a*1 of the inner plug 53 is prevented from dripping from the ink holding portion 53*a*1 by the surface tension and the ink cartridge 40 can be thus carried at ease.

As described in aforementioned FIGS. 6(*a*) to 6(*d*), the pulling out of the socket portion 50 from the joint portion 30 includes: sealing the ink passage is sealed by releasing the insertion shaft 31*f* from the pressing of the ink holding portion 53*a*1; then releasing the fitting state between the joint portion 30 and the socket portion 50; and then pulling out the insertion shaft 31*f* from the ink holding portion 53*a*1.

An experiment of ink drip from the ink supply port 51*e* of the socket main body 51 was performed by mounting the ink cartridge 40 on the holder 21 of the printing machine 10 in a same manner as in an actually-mounted state and alternately repeating the fitting operations shown in FIGS. 5(*a*) to 5(*c*) and the pull-out operations shown in FIGS. 6(*a*) to 6(*d*). The results of table 1 shown below were obtained from this experiment.

TABLE 1

| | Example 1 | Example 2 | Example 3 | Comparative Example |
|---|---|---|---|---|
| Depth F of ink holding portion 53a1 | 6 mm | 11 mm | 14 mm | 0 mm (Current) |
| Total ink drip amount in 1st to 10th operations | 0.09 | 0.45 | 0.53 | 0.55 |
| Total ink drip amount in 11th to 20th operations | 0.06 | 0.36 | 0.53 | 0.66 |
| Total ink drip amount in 21st to 30th operations | 0.11 | 0.28 | 0.50 | 0.58 |
| Total ink drip amount in 31st to 40th operations | 0.06 | 0.38 | 0.56 | 0.86 |
| Total ink drip amount in 41st to 50th operations | 0.09 | 0.34 | 0.54 | 0.59 |
| Overall average value | 0.08 | 0.36 | 0.53 | 0.65 |

Unit of ink drip amount: g

Here, the experiment was performed with the shaft diameter ϕd (FIG. 4(*d*)) of the insertion shaft 31*f* of the joint main body 31 set to 2 mm and the hole diameter ϕD (FIG. 4(*d*)) of the ink holding portion 53*a*1 of the inner plug 53 set to 2.5 mm.

Moreover, the experiment was performed with the depth F (FIG. 4(*d*)) of the ink holding portion 53*a*1 of the inner plug 53 set to 6 mm in Example 1, to 11 mm in Example 2, to 14 mm in Example 3, and to 0 mm (current) in Comparative Example.

Then, for each examples, an attaching-detaching operation was repeated 50 times and the total ink drip amount (g) per ten times of attaching-detaching operations, i.e., 1st to 10th, 11th to 20th, 21st to 30th, 31st to 40th, and 41st to 50th operations, was measured. Then, the overall average value of ink drip amount (g) was obtained from these measured values.

As shown in Table 1, the ink drip amount (g) was 0.08 g in Example 1, 0.36 g in Example 2, 0.53 g in Example 3, and 0.65 g in Comparative Example.

It is found from this that the ink drip amount from the ink holding portion 53*a*1 of the inner plug 53 can be reduced by setting the depth F (FIG. 4(*d*)) of the ink holding portion 53*a*1 within a range of 6 mm to 14 mm on the basis of Examples 1 to 3.

Meanwhile, in Comparative Example (current), since no ink holding portion 53*a*1 was formed in the front portion of the inner plug 53, the ink drip amount was large and the Comparative Example could not be used in practice. In the embodiment, the ink drip was improved by forming the ink holding portion 53*a*1 in the front portion of the inner plug 53.

Next, examples of the shapes of the ink holding portion 53*a*1 formed in the front portion of the inner plug 53 are described by using FIGS. 7A to 7F.

Figure 7A:
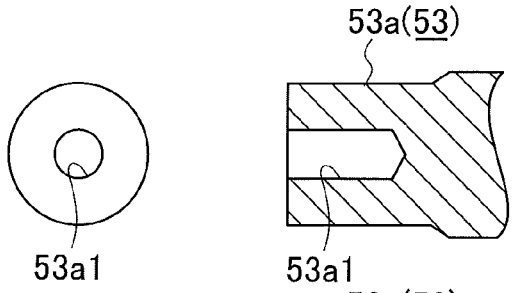
FIGS. 7A to 7F are views each showing a shape of an ink holding portion formed on a distal end side of an inner plug in a socket main body in the ink cartridge in the embodiment of the present invention.

First, the ink holding portion 53*a*1 of the embodiment which is shown in FIG. 7A is formed in the front portion of the first cylinder portion 53*a* of the inner plug 53 as a bottomed hole having a columnar recess shape, as described above.

Figure 7B:
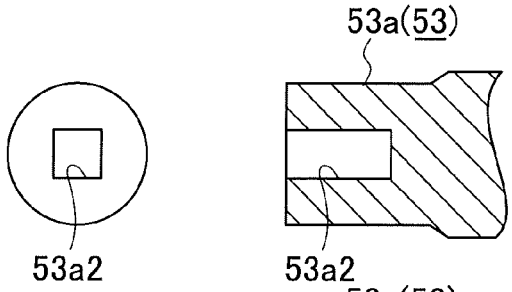

Next, an ink holding portion 53*a*2 of Modified Example 1 which is shown in FIG. 7B is formed in the front portion of the first cylinder portion 53*a* of the inner plug 53 as a bottomed hole having a quadrangular prism recess shape.

Figure 7C:
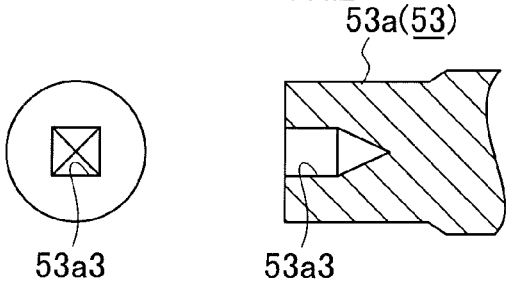

Next, an ink holding portion 53*a*3 of Modified Example 2 which is shown in FIG. 7C is formed in the front portion of the first cylinder portion 53*a* of the inner plug 53 as a bottomed hole having a quadrangular pyramid recess shape.

Figure 7D:
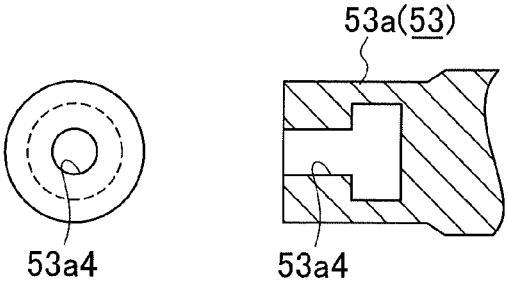

Next, an ink holding portion 53*a*4 of Modified Example 3 which is shown in FIG. 7D is formed in the front portion of the first cylinder portion 53*a* of the inner plug 53 as a bottomed hole having a two-stage column recess shape in which a rear portion is wider.

Figure 7E:
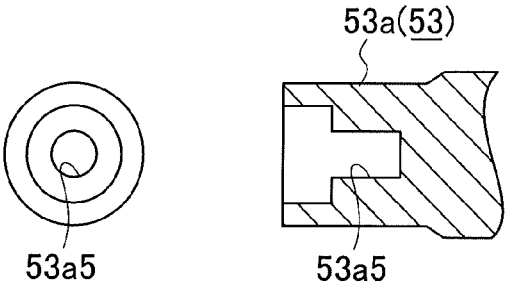

Next, an ink holding portion 53*a*5 of Modified Example 4 which is shown in FIG. 7E is formed in the front portion of the first cylinder portion 53*a* of the inner plug 53 as a bottomed hole having a two-stage column recess shape in which a front portion is wider.

Figure 7F:
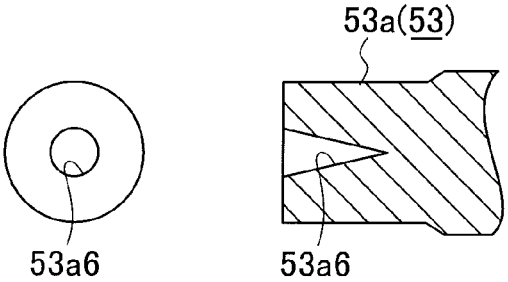

Next, an ink holding portion 53*a*6 of Modified Example 5 which is shown in FIG. 7F is formed in the front portion of the first cylinder portion 53*a* of the inner plug 53 as a bottomed hole having a conical recess shape.

Moreover, as described above, the insertion shaft 31*f* is formed in the joint main body 31 in the shape extending in the axial direction and the distal end of the insertion shaft 31*f* is formed to correspond to the shape of each of the ink holding portions 53*a*1 to 53*a*6 and to be capable of pressing the ink holding portion. In such a case, in each of the embodiment and Modified Examples 1 to 4, the corresponding one of the ink holding portions 53*a*1 to 53*a*5 is formed to be a recess portion having a surface parallel to the axis of the insertion shaft 31*f*. Accordingly, the dripping of the ink IK from the ink supply port 51*e* in the direction of gravity can be suppressed even when the ink cartridge 40 is installed while being inclined at about 2° in the printing machine 10.

Meanwhile, in Modified Example 5 described above, the ink holding portion 53*a*6 is not formed to be a recess portion having a surface parallel to the axis of the insertion shaft 31*f* and has the conical recess shape. However, the dripping of the ink IK from the ink supply port 51*e* can be suppressed by setting the diameter of the ink holding portion 53*a*6 on an entrance side slightly larger than the diameter of the insertion shaft 31*f*.

Regarding the ink cartridge 40 described above in detail, by using FIGS. 4(*a*) to 4(*d*), description is given of the example in which the insertion shaft 31*f* formed in the center portion of the distal end circular recess portion 31*e* of the joint main body 31 of the joint portion 30 protrudes forward beyond the joint main body 31. However, the present invention is not limited to this configuration and the distal end circular recess portion 31*e* of the joint main body 31 can be extended to a position near the distal end sharp portion 31*f*1 of the insertion shaft 31*f*. In this case, the distal end annular recess portion 51*af* of the socket main body 51 is formed deeper according to the length of the distal end circular recess portion 31*e* of the joint main body 31 so as to meet the extended length.

Moreover, regarding the ink cartridge 40, description is given of the example in which the joint portion 30 is moved in the front-rear directions, i.e., in the directions toward and away from the socket portion 50 by the cam drive mechanism 11 when the socket portion 50 is fitted to the joint portion 30 in the printing machine 10 and pulled out therefrom. However, the present invention is not limited to this and may be configured such that the joint portion 30 is fixedly installed in the printing machine 10 and the socket portion 50 of the ink cartridge 40 is manually fitted to the fixedly-installed joint portion 30 and pulled out from the joint portion 30. Also in this case, by employing the embodiment, it is possible to perform a manual pull-out of the socket portion 50 from the joint portion 30 which includes: sealing the ink passage to the ink supply port 51*e* by releasing the insertion shaft 31*f* from the pressing of the ink holding portion 53*a*1; then releasing the fitting state between the joint portion 30 and the socket portion 50; and then pulling out the insertion shaft 31*f* from the ink holding portion 53*a*1.

Embodiments of the present invention have been described above. However, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

Moreover, the effects described in the embodiments of the present invention are only a list of optimum effects achieved by the present invention. Hence, the effects of the present invention are not limited to those described in the embodiment of the present invention.

What is claimed is:

1. An ink cartridge comprising:

an ink storage container configured to store ink;

a socket portion provided at one end of the ink storage container and configured to be fitted to and detached from a joint portion of a printing machine;

an ink supply port provided in the socket portion; and an inner plug configured to seal an ink passage to the ink supply port in response to biasing force applied from a side of the ink storage container, wherein the inner plug includes an ink holding portion for an insertion shaft provided in the joint portion to be inserted, the insertion shaft pressing the inner plug against the biasing force upon a fitting of the socket portion to the joint portion enables the ink passage to communicate with the ink supply port, and the ink holding portion with the insertion shaft pulled out from the ink holding portion after inserted holds the ink near the ink supply port.

2. The ink cartridge according to claim 1, wherein pulling out of the socket portion from the joint portion includes: sealing the ink passage by releasing the insertion shaft from pressing the ink holding portion; then releasing a fitting state between the joint portion and the socket portion; and then pulling out the insertion shaft from the ink holding portion.

3. The ink cartridge according to claim 1, wherein the insertion shaft is provided in a shape extending in a direction of an axis of the insertion shaft, and the ink holding portion is a recess portion having a surface parallel to the axis of the insertion shaft.

* * * * *